US012624841B2

(12) United States Patent
Liao

(10) Patent No.: US 12,624,841 B2
(45) Date of Patent: May 12, 2026

(54) SPLIT-TYPE RANGE HOOD HAVING OPTIMAL CONFIGURATION OF SMOKE-COLLECTING CASE

(71) Applicant: BLUESKY COOKING STYLE CO., LTD., Taipei City (TW)

(72) Inventor: Chin-Jung Liao, Taipei City (TW)

(73) Assignee: BLUESKY COOKING STYLE CO., LTD., Taipei City (TW)

( * ) Notice: Subject to any disclaimer, the term of this patent is extended or adjusted under 35 U.S.C. 154(b) by 392 days.

(21) Appl. No.: 18/465,995

(22) Filed: Sep. 13, 2023

(65) Prior Publication Data

US 2024/0093880 A1 Mar. 21, 2024

(30) Foreign Application Priority Data

Sep. 14, 2022 (TW) ..... 111134630

(51) Int. Cl.
*F24C 15/20* (2006.01)

(52) U.S. Cl.
CPC ..... *F24C 15/2071* (2013.01); *F24C 15/2035* (2013.01)

(58) Field of Classification Search
CPC ..... F24C 15/2071; F24C 15/2035
USPC ..... 126/299 D
See application file for complete search history.

(56) References Cited

U.S. PATENT DOCUMENTS 3,583,306 A * 6/1971 Hagdorn ..... F24C 15/2028 219/400
4,266,528 A * 5/1981 Barnhart ..... F24C 15/20 126/299 D
5,163,869 A * 11/1992 Yeh ..... F24C 15/2021 454/67
2002/0083691 A1* 7/2002 Chang ..... B01D 46/0005 55/385.1
2009/0305621 A1 12/2009 Eckardt et al.
2015/0114384 A1* 4/2015 Bruin-Slot ..... F24C 15/20 126/299 D
2023/0151823 A1* 5/2023 Lei ..... F04D 29/4226 126/299 R

FOREIGN PATENT DOCUMENTS

| | | | | |
|---|---|---|---|---|
| CN | 108386890 A | | 8/2018 | |
| CN | 112377462 B | * | 12/2021 | ..... F04D 29/626 |
| EP | 1784605 B1 | | 11/2007 | |
| TW | M269414 U | | 7/2005 | |
| TW | I750684 B | | 12/2021 | |
| TW | M636498 U | | 1/2023 | |

OTHER PUBLICATIONS

2021 CN DOC Translation, Lei.*

* cited by examiner

*Primary Examiner* — Avinash A Savani
(74) *Attorney, Agent, or Firm* — Li & Cai Intellectual Property Office

(57) ABSTRACT

A split-type range hood having an optimal configuration of a smoke-collecting case includes a housing and the smoke-collecting case. The housing has an upper wall, a lower wall, and an intake port. The smoke-collecting case covers on the intake port. The smoke-collecting case has an outer box and a covering lid. The outer box is fixed to a periphery of the intake port. The covering lid is fixedly connected to a top portion of the outer box. The covering lid has an outlet port that fluidly connects the smoke-collecting case to the intake port of the housing. A height of the smoke-collecting case is between 5 cm and 7 cm.

9 Claims, 9 Drawing Sheets

SPLIT-TYPE RANGE HOOD HAVING OPTIMAL CONFIGURATION OF SMOKE-COLLECTING CASE

CROSS-REFERENCE TO RELATED PATENT APPLICATION

This application claims the benefit of priority to Taiwan Patent Application No. 111134630, filed on Sep. 14, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a split-type range hood having an optimal configuration of a smoke-collecting case, and more particularly to a split-type range hood having a blower unit being separate from the smoke-collecting case, and the smoke-collecting case having an optimal configuration.

BACKGROUND OF THE DISCLOSURE

As shown in FIG. 1, a conventional range hood such as an island range hood 9 has a top wall 91 and a bottom wall 92, and includes a smoke-collecting cap 93, a fan motor 95, and a hood filter 96. The smoke-collecting cap 93 is disposed on the top wall 91, the fan motor 95 is disposed in the smoke-collecting cap 93, and the hood filter 96 is disposed on the bottom wall 92. During the use of the conventional range hood, the noise from the fan motor 95 may not be prevented from affecting the kitchen. Furthermore, when a cooking fume passes through the hood filter 96 and the smoke-collecting cap 93, and then is exhausted by the fan motor 95 outside the range hood 9, the fume usually remains between the top wall 91 and the bottom wall 92. The fume also easily remains at the corners of the smoke-collecting cap 93, and cannot be smoothly exhausted outside. These issues cause the range hood 9 to have low efficiency, accumulation of fumes, and shortened life span.

In another conventional technology associated with the relevant art, the fan motor is arranged to be outside the smoke-collecting cap, and the fan motor is disposed outside the kitchen room for noise reduction similar to the way of a split-type air conditioner. For example, in Taiwan Patent No. TWI750684 "Split-Type Range Hood" as filed by the applicant of the present disclosure, the fan motor is disposed outside the smoke-collecting cap so as to be separated from the range hood as an outdoor split blower unit. However, after removing the fan motor outside, the space inside the smoke-collecting cap becomes larger, and the fluid phenomenon in the smoke-collecting cap is changed, so as to affect the speed and sound of the fume exhausting flow.

Considering the flow phenomenon in the smoke-collecting cap, when an object is moving in an air flow, viscous air molecules will attach on the object and form a boundary layer. When a flow distance of the air flow is increased, a disorder and unpredictable turbulent flow is formed. Gases move randomly to form different vortices, which causes energy to be lost. Moreover, if an exhaust duct above the smoke-collecting cap is bent, a partial resistance may be formed.

Furthermore, the smoke-collecting cap is made of metal boards with bending processes and is usually connected to the housing through screws or rivets. The interior of the smoke-collecting cap, which is used to collect the fume, inevitably has some fixing screws that are exposed. These fixing screws are not only unaesthetic, but also cause turbulence in the flow of the fume, so that the fume does not flow smoothly. In addition, residue of the fume can remain on screws and is difficult to be cleaned and wiped off.

Therefore, how to improve the internal fluid performance in the smoke-collecting cap through an improvement in structural design to overcome the above-mentioned problems has become one of the important issues to be solved in this field.

SUMMARY OF THE DISCLOSURE

In response to the above-referenced technical inadequacies, the present disclosure provides a split-type range hood having an optimal configuration of a smoke-collecting case, which provides a smoke-collecting case that is able to improve the fluid flow performance in the smoke-collecting cap, so as to improve a smoothness of an airflow of a fume.

In order to solve the above-mentioned problems, one of the technical aspects adopted by the present disclosure is to provide a split-type range hood having an optimal configuration, which includes a housing and a smoke-collecting case. The housing includes an upper wall, a lower wall, and an intake port. The intake port is fluidly connected to the upper wall and the lower wall. The smoke-collecting case covers the intake port, and protrudes above the upper wall. The smoke-collecting case includes an outer box and a covering lid. The outer box is fixed to a periphery of the intake port. The covering lid is fixedly connected to a top portion of the outer box. The covering lid has an outlet port. The outlet port fluidly connects the smoke-collecting case to the intake port of the housing. A height of the smoke-collecting case is between 1 cm and 10 cm, so that a fume passes through the smoke-collecting case to be exhausted outside from the outlet port of the covering lid.

Therefore, in the present disclosure, when the split-type range hood having an optimal configuration of a smoke-collecting case has a height between 1 cm and 10 cm, the flow speed at the entrance of the outlet port can be increased, and the noise can be reduced. Therefore, the fume can be more smoothly exhausted outside through the guiding shell of the smoke-collecting case.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
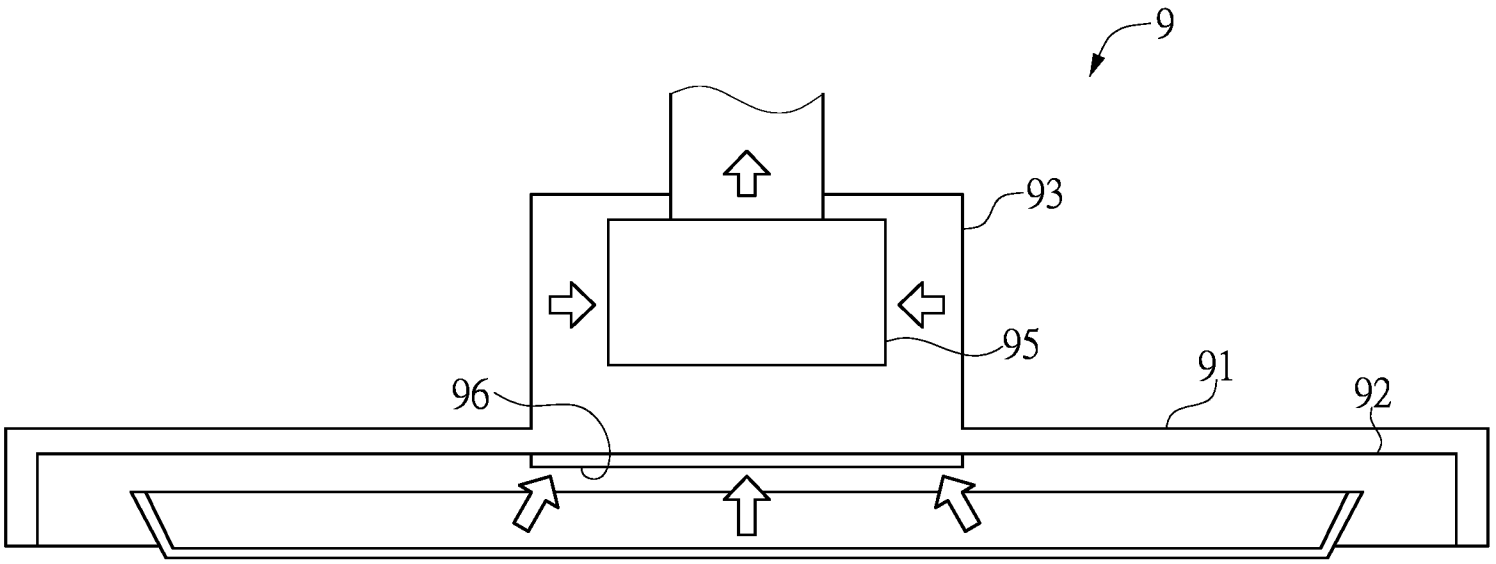
FIG. 1(Related Art)
FIG. 1 is a schematic view of a split-type range hood of related art.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

First Embodiment

Figure 5:
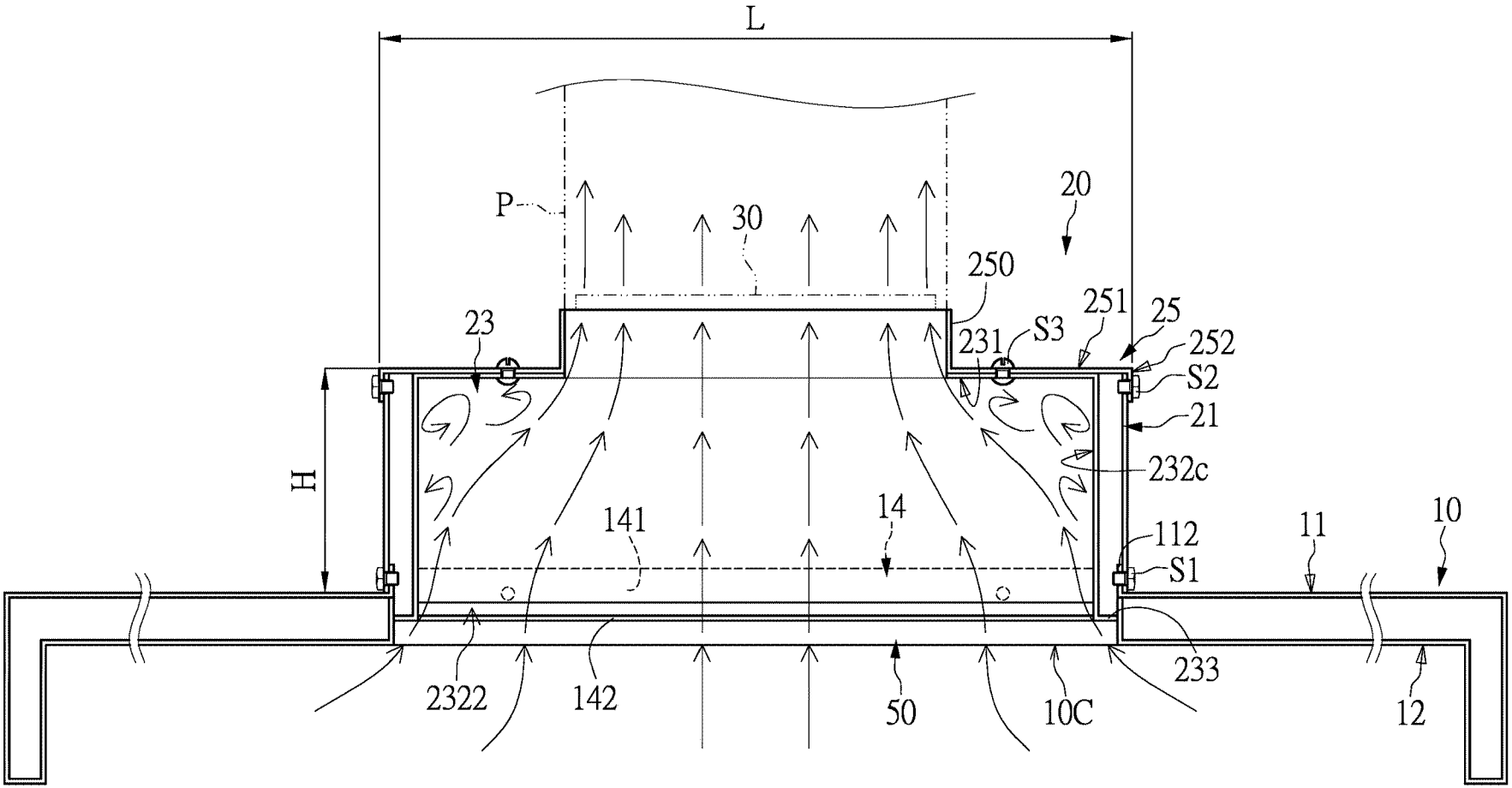
FIG. 5 is a cross-sectional view taken along line V-V of FIG. 4.
Figure 6:
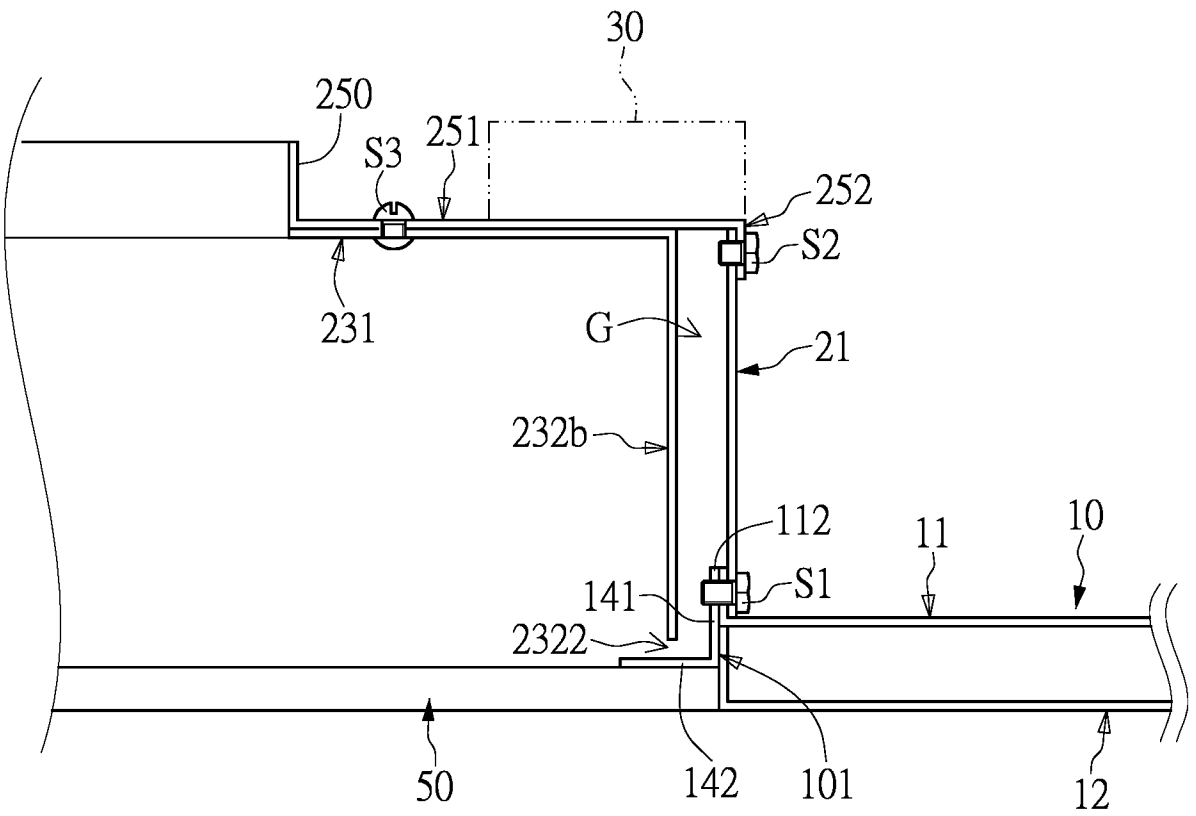
FIG. 6 is a cross-sectional view taken along line VI-VI of FIG. 5.
Figure 7:
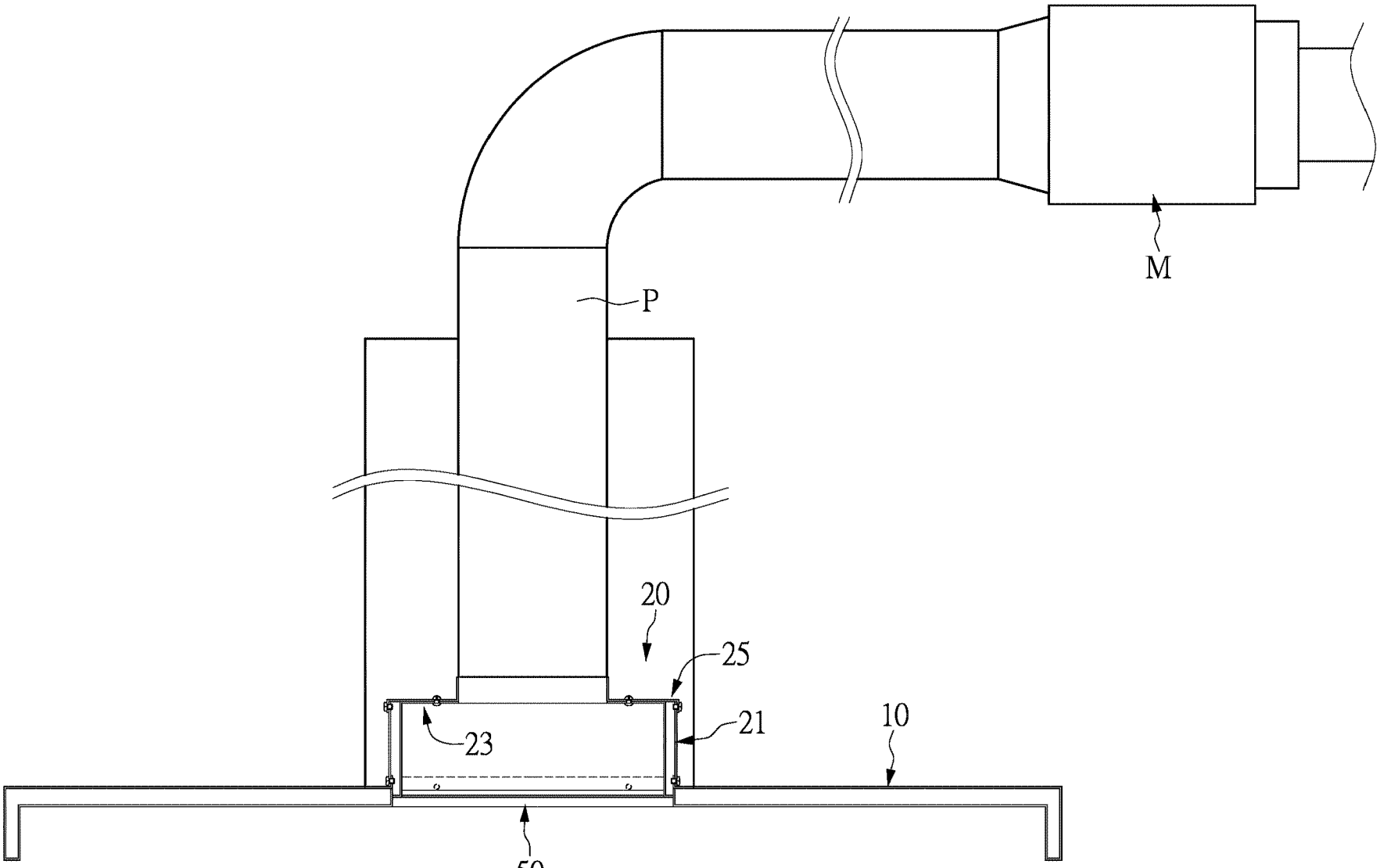
FIG. 7 is a schematic view of the split-type range hood of the present disclosure after mounting.

Referring to FIG. 2 to FIG. 7, a first embodiment of the present disclosure provides a split-type range hood having an optimal configuration of a smoke-collecting case 100, or a split-type range hood 100 for sake of brevity, which includes a housing 10 and a smoke-collecting case 20. As shown in FIG. 7, a blower unit M is arranged outside the smoke-collecting case 20, the split-type range hood 100 exhausts the air flow outside by an exhaust duct P connected to the blower unit M.

Figure 2:
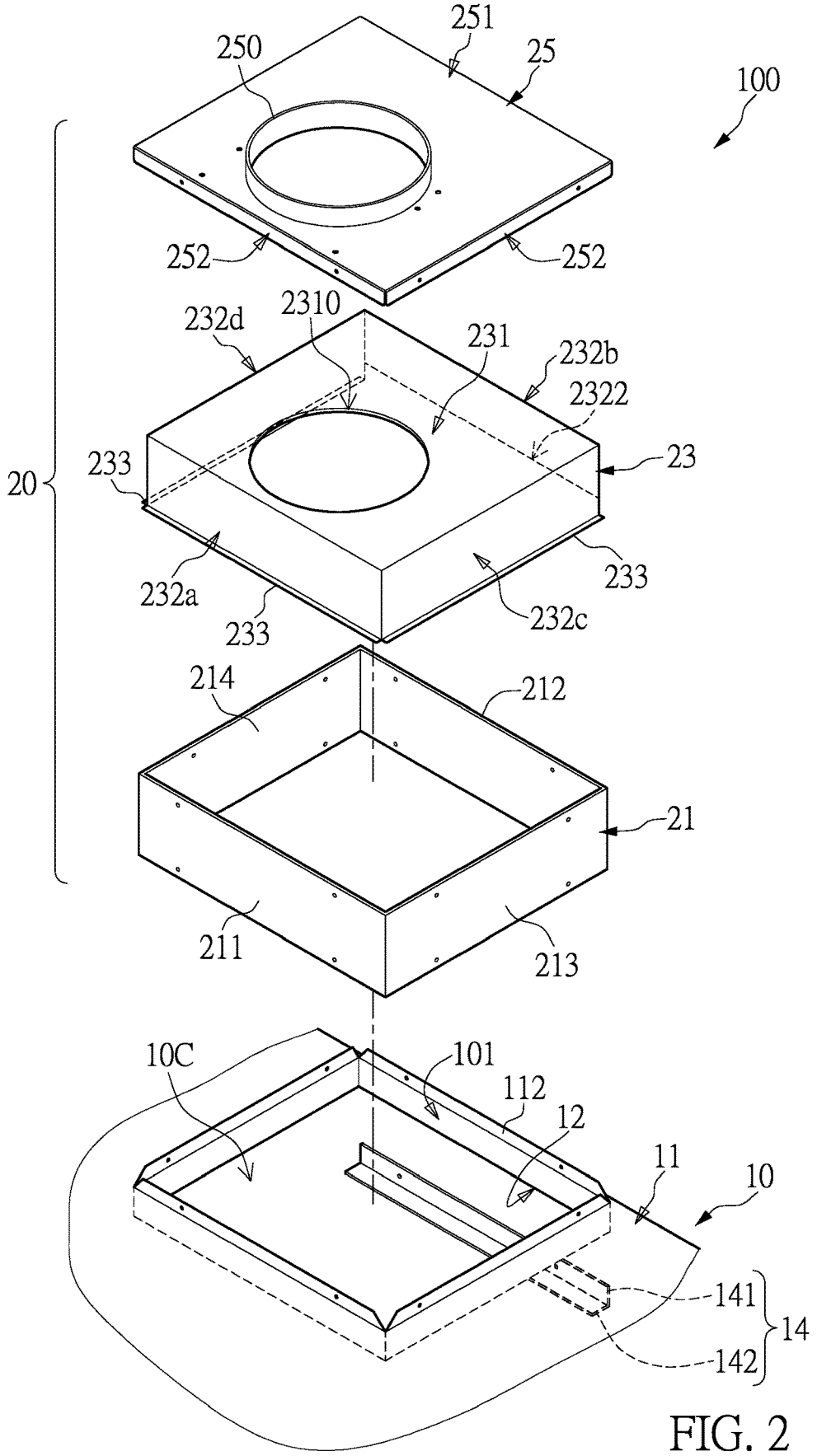
FIG. 2 is a perspective exploded view of a split-type range hood according to a first embodiment of the present disclosure.
Figure 3:
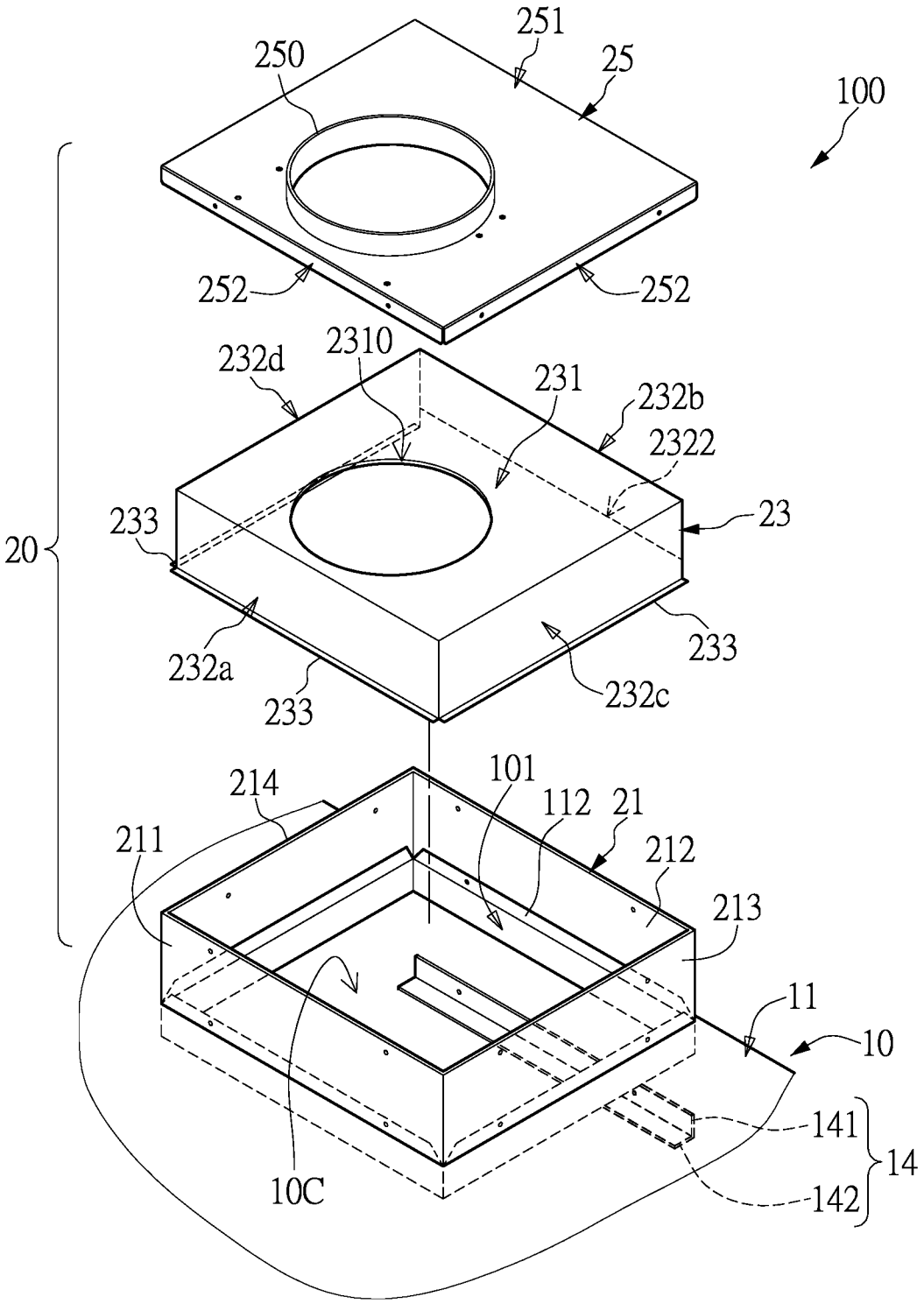
FIG. 3 is another perspective exploded view of the split-type range hood according to the first embodiment of the present disclosure.

As shown in FIG. 2 and FIG. 3, the housing 10 includes an upper wall 11, a lower wall 12, and an intake port 10C. The intake port 10C passes through the upper wall 11 and the lower wall 12. The housing 10 is substantially an inverted rectangular housing. The upper wall 11 is parallel to the lower wall 12. However, the present disclosure is not limited thereto. For example, the lower wall 12 can be arranged in a slanted manner and be obliquely disposed under the upper wall 11. The intake port 10C indicates an inlet portion for the fume to flow therein. In this embodiment, the intake port 10C is shaped in a rectangle.

The smoke-collecting case 20 covers on the intake port 10C, and protrudes above the upper wall 11. The smoke-collecting case 20 includes an outer box 21, a guiding shell 23, and a covering lid 25. The outer box 21 is fixed to a periphery of the intake port 10C. For example, a portion of the outer box 21 adjacent to a bottom edge of the outer box 21 is fixed on an upper edge of the intake port 10C or an inner wall of the intake port 10C by fixing elements such as screws or rivets. Details thereof will be described later. The outer box 21 provides a fixing function. The guiding shell 23 is disposed in an interior of the outer box 21, and provides a smooth surface, which can enhance the smoothness of the air flow and cleanliness thereof can be easily maintained. The covering lid 25 includes an outlet port 250. The outlet port 250 fluidly connects the smoke-collecting case 20 to the intake port 10C of the housing 10. The covering lid 25 is fixedly connected to a top portion of the outer box 21 by way of screwing or riveting. Details of the connection will be described with examples later. The top end of the guiding shell 23 is fixedly connected to the covering lid 25 by way of spot welding or riveting. Details of the connection will be described with examples later.

As shown in FIG. 2 and FIG. 3, in this embodiment, the outer box 21 includes four box plates (211, 212, 213, and 214) each in a shape of a rectangular tube. The guiding shell 23 has four sides which are arranged to have a shape of a rectangular tube. The upper wall 11 of the housing 10 has four connection walls 112. The four connection walls 112 extend upward and are bent from the upper walls 11 along a periphery of the intake port 10C. A bottom portion of the outer box 21 is fixedly connected to the connection walls 112. For example, as shown FIG. 5 and FIG. 6, fixing elements S1, such as screws or rivets, pass through the outer box 21 and connection walls 112. However, the present disclosure is not limited thereto. For example, the bottom portion of the outer box 21 is screwed to an inner wall 101 of the intake port 10C.

The guiding shell 23 is disposed in the outer box 21. A bottom edge of the guiding shell 23 does not extend beyond the lower wall 12 of the housing 10, and is spaced apart from the lower wall 12 by a predetermined distance. As shown in FIG. 5, the predetermined distance provides an assembling space for a hood filter 50.

As shown in FIG. 2 and FIG. 3, the guiding shell 23 includes a top guiding wall 231 and four side guiding walls (232*a*, 232*b*, 232*c*, 232*d*). A bottom edge of the guiding shell 23 has a plurality of shielding tabs 233 extended outwardly. A quantity of the shielding tabs 233 can be equal to or less than that of the side guiding walls (232*a*, 232*b*, 232*c*, 232*d*). In this embodiment, three shielding tabs 233 are provided. The shielding tabs 233 are close to the inner wall 101 of the intake port 10C. The four side guiding walls (232*a*, 232*b*, 232*c*, 232*d*) are connected to a periphery of the top guiding wall 231. Three of the shielding tabs 233 are connected to three of the side guiding walls (232*a*, 232*b*, 232*c*). In this embodiment, the guiding shell 23 includes three shielding tabs 233 and four side guiding walls (232*a*, 232*b*, 232*c*, 232*d*), in which the side guiding wall 232*b* has no shielding tab. A height of the side guiding wall 232*b* is smaller than a height of another three of the side guiding walls (232*a*, 232*c*, 232*d*), so that a concave portion 2322 can be formed.

In this embodiment, a vent 2310 is formed on the top guiding wall 231. The shape and position of the vent 2310 correspond with the shape and the position of the outlet port 250. Specifically, the vent 2310 of this embodiment is circle-shaped, and has a diameter of 6 inches (substantially 15.3 cm). The top guiding wall 231 is fixedly connected to the covering lid 25 by the fixing element S3 (as shown in FIG. 5, and FIG. 6), such as a rivet. A round-headed rivet allows the inner wall to be smoother. In another way, the top guiding wall 231 and the covering lid 25 can be connected to each other by spot welding. The advantage of spot welding is that, no fixing element is exposed outside the inner wall, so that the appearance is enhanced and turbulence is reduced.

As shown in FIG. 2 and FIG. 3, the covering lid 25 includes a top covering wall 251 and a plurality of assembling flaps 252. The covering lid 25 can be made of metal board by way of bending and other processes. The assembling flaps 252 extend and are bent downward from a periphery of the top covering wall 251. The outlet port 250 protrudes upward from the top covering wall 251 by a process, such as an integrally drawing process. The assembling flaps 252 are fixedly connected to the outer box 21. For example, fixing elements S2 (as shown in FIG. 5 and FIG. 6), such as screws or rivets, are used to pass through the assembling flaps 252 and upper portions of the box plates (211, 212, 213, and 214) of the outer box 21, so that the covering lid 25 is fixedly connected to the outer box 21. However, the present disclosure is not limited thereto. For example, the covering lid 25 and the guiding shell 23 can be made from one metal board by way of bending and other processing processes. Furthermore, the walls on the periphery of the covering lid 25 can extend continuously to integrally form four box plates of the outer box 21.

By the above-mentioned structural configuration, the guiding shell 23 covers the fixing element S1, S2, such as screws or rivets, of the outer box 21, thereby providing an aesthetically pleasing appearance, and reducing the turbulence of the fume. The fume can pass through the guiding shell 23 more smoothly and is exhausted out from the outlet port 250 of the covering lid 25. In addition, the fume is not attached by screws, so that cleanliness is easily maintained and the guiding shell 23 can be more smoothly wiped clean.

Figure 4:
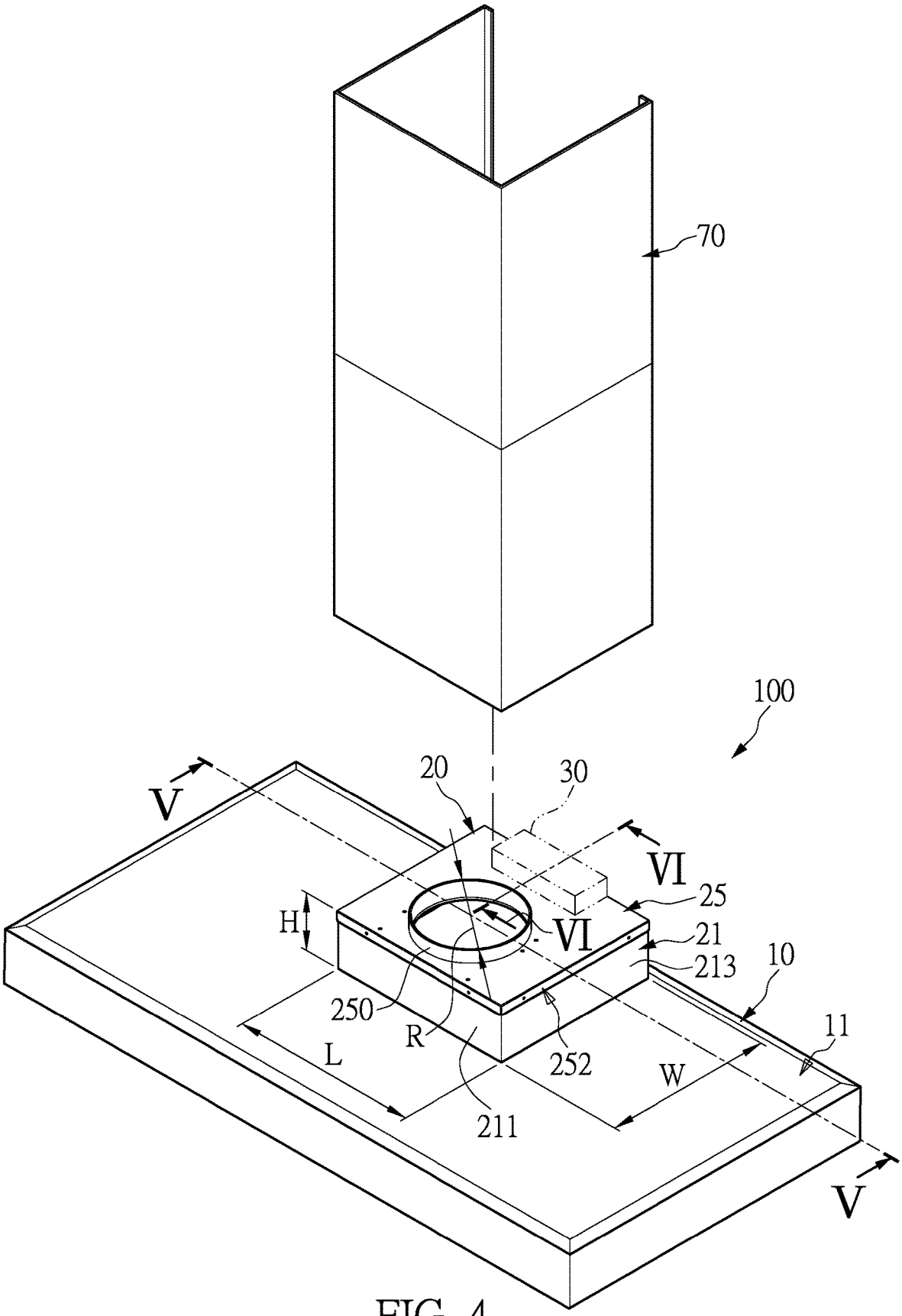
FIG. 4 is a perspective assembled view of the split-type range hood according to the first embodiment of the present disclosure.

Reference is made to FIG. 4 and FIG. 7. FIG. 4 shows a perspective view of the smoke-collecting case 20 being assembled to the housing 10. In this embodiment, the blower unit M, or referred to as a split-type machine, is moved outside the smoke-collecting case 20. Such arrangement not only reduces the noise indoor, but also lowers a height H of the smoke-collecting case 20. Therefore, the height and weight of the indoor mechanism of the split-type range hood 100 can be significantly reduced, thereby facilitating a convenient assembly. A decorative sleeve 70 is arranged on the outside of the smoke-collecting case 20.

Referring to FIG. 4, according to this embodiment, a length L of the outer box 21 (i.e., a horizontal width of the box plate 211 close to a user) is 29 cm. The width W of the outer box 21 (i.e., a horizontal width of the box plate 213 or 214 adjacent to the box plate 211) is 26 cm. Because the shape of the outer box 21 corresponds to that of the intake port 10C, the size of the intake port 10C is also 29 cm by 26 cm. The outlet port 250 of the covering lid 25 corresponds in position to an air inlet of the blower unit M, and the air inlet has a diameter R of 6 inches (substantially 15.3 cm).

Referring to FIG. 7, in this embodiment, the fume is transferred from the smoke-collecting case 20 having a larger square area to the outlet port 250 of the covering lid 25, and then is exhausted from the exhaust duct P. Such structure causes a local resistance in fluid mechanics From the intake port 10C to the outlet port 250, the cross-sectional area of the smoke-collecting case 20 is suddenly reduced. The fluid forms a flow separation region at corners of an upper region inside the smoke-collecting case 20, and at an exit area of the outlet port 250. In other words, the fluid forms a turbulent region, and certain degree of an energy loss is inevitable.

The energy loss has at least two parameters. A first parameter of the energy loss is a ratio of an area of the outlet port to an area of the intake port, which is substantially 0.24:1. As shown in FIG. 3 and FIG. 4, a ratio of an area of the outlet port 250 ($((0.5R)^2*3.14=((0.5*15.3)^2*3.14))$, to an area of the intake port 10C (L*W=29*26), is substantially 0.24:1. Such ratio is a parameter that would affect the local resistance. When the ratio is 1, the local resistance has a minimum value. When the ratio is maintained to be substantially 0.24:1, a second parameter is the height H of the smoke-collecting case 20. Experiments are performed according to the present disclosure. When the height H of the smoke-collecting case 20 exceeds a predetermined height, and when a motor suction is maintained to be the same, the higher the height H of the smoke-collecting case 20 is, the lower the flow speed at the outlet port 250 is. As shown in FIG. 5, the reason for the abovementioned phenomenon may be that the higher the height H of smoke-collecting case 20 is, the bigger the turbulent region along the inner wall of the smoke-collecting case 20 is. Accordingly, the bigger the turbulent region is, the more vortexes which cause energy loss there are.

According to experiments, if the height H of the outer box 21 is 18 cm, the flow speed at the entrance of the outlet port 250 is substantially from 5.8 msec to 6.2 msec and a volume under the housing 10 is 58 decibels. If the height H of the outer box 21 is 7 cm, the flow speed at the entrance of the outlet port 250 is substantially from 7.0 m/sec to 7.2 m/sec, and the volume under the housing 10 is 56 decibels. Comparing the two experiments, the flow speed at the entrance of the outlet port 250 can be increased, the noise is reduced, and an overall exhaust airflow is smoother. When the height H of the outer box 21 is between 1 cm and 10 cm, the flow speeds at the outlet port 250 are substantially the same. Preferably, the height H of the outer box 21 is 7 cm. When the height H of the outer box 21 is larger than 18 cm, the flow speed at the entrance of the outlet port 250 becomes lower.

Referring to FIG. 5, FIG. 5 is a cross-sectional view taken along line V-V of FIG. 4. When viewing from an interior of the split-type range hood 100, the guiding shell 23 shields the outer box 21 and the fixing elements S1, S2. The fixing elements S1, S2 of the outer box 21 are arranged at an outside of the guiding shell 23, and only the guiding shell 23 can be seen. The shielding tabs 233 of the guiding shell 23 are adjacent to the inner wall 101 of the intake port 10C. According to the present disclosure, the guiding shell 23 is arranged in the outer box 21, so that the interior of the smoke-collecting case 20 is more aesthetically pleasing, and the turbulence of the fume can be reduced. Through the guiding shell 23, the fume can be exhausted outside more smoothly from the outlet port 250 of the covering lid 25.

Reference is made to FIG. 3 and FIG. 6. FIG. 6 is a cross-sectional view taken along line VI-VI of FIG. 4. In this embodiment, the side guiding wall 232*b* does not have any shielding tab, and the concave portion 2322 is formed. In other words, the quantity (three) of the shielding tabs 233 is less than the quantity (four) of the side guiding walls (232*a*, 232*b*, 232*c*, 232*d*). All the side guiding walls, (including 232*b*) are separated away from the outer box 21 by a distance so that a gap G is formed. The above structure of this embodiment has another advantage that, the gap G and the concave portion 2322 can be used as a wiring space for wires. Therefore, the guiding shell 23 can be designed without any wire hole to improve the appearance of the guiding shell 23, and the smoothness of a fume flow.

Referring to FIG. 3, FIG. 5, and FIG. 6, in order to cooperate with the gap G and the concave portion 2322, the split-type range hood 100 further includes an auxiliary-shielding member 14. The auxiliary-shielding member 14 is fixed to one side of the inner walls 101 of the intake port 10C, and shields the concave portion 2322. In this embodiment, the auxiliary-shielding member 14 is L-shaped, and includes a vertical portion 141 and a horizontal portion 142. As shown in FIG. 5 and FIG. 6, the vertical portion 141, the outer box 21, and the connection wall 112 are fixedly connected by the fixing element S1 such as screws or rivets. In another way, the vertical portion 141 can be fixedly connected to one side of the inner wall 101 of the intake port 10C. The auxiliary-shielding member 14 extends in two lateral sides and shields two of the shielding tabs 233.

Referring to FIG. 6, the split-type range hood 100 of the present disclosure further includes a control box 30. The control box 30 is disposed on a top surface of the covering lid 25 of the smoke-collecting case 20. Controlling wires (not shown in the figures) can be arranged to pass through the wiring space between the upper wall 11 and the lower wall 12 of the housing 10, the inner wall 101, the auxiliary-shielding member 14, the gap G, and the top covering wall 251 of the covering lid 25, and then connect to the control box 30. Thus, the wires can be completely hidden. In other words, wires do not need to pass through the guiding shell 23, and the guiding shell 23 does not need any wire hole.

The split-type range hood 100 of the present disclosure further includes a hood filter 50. The hood filter 50 is disposed on the intake port 10C, and abuts against the auxiliary-shielding member 14.

Second Embodiment

Figure 8:
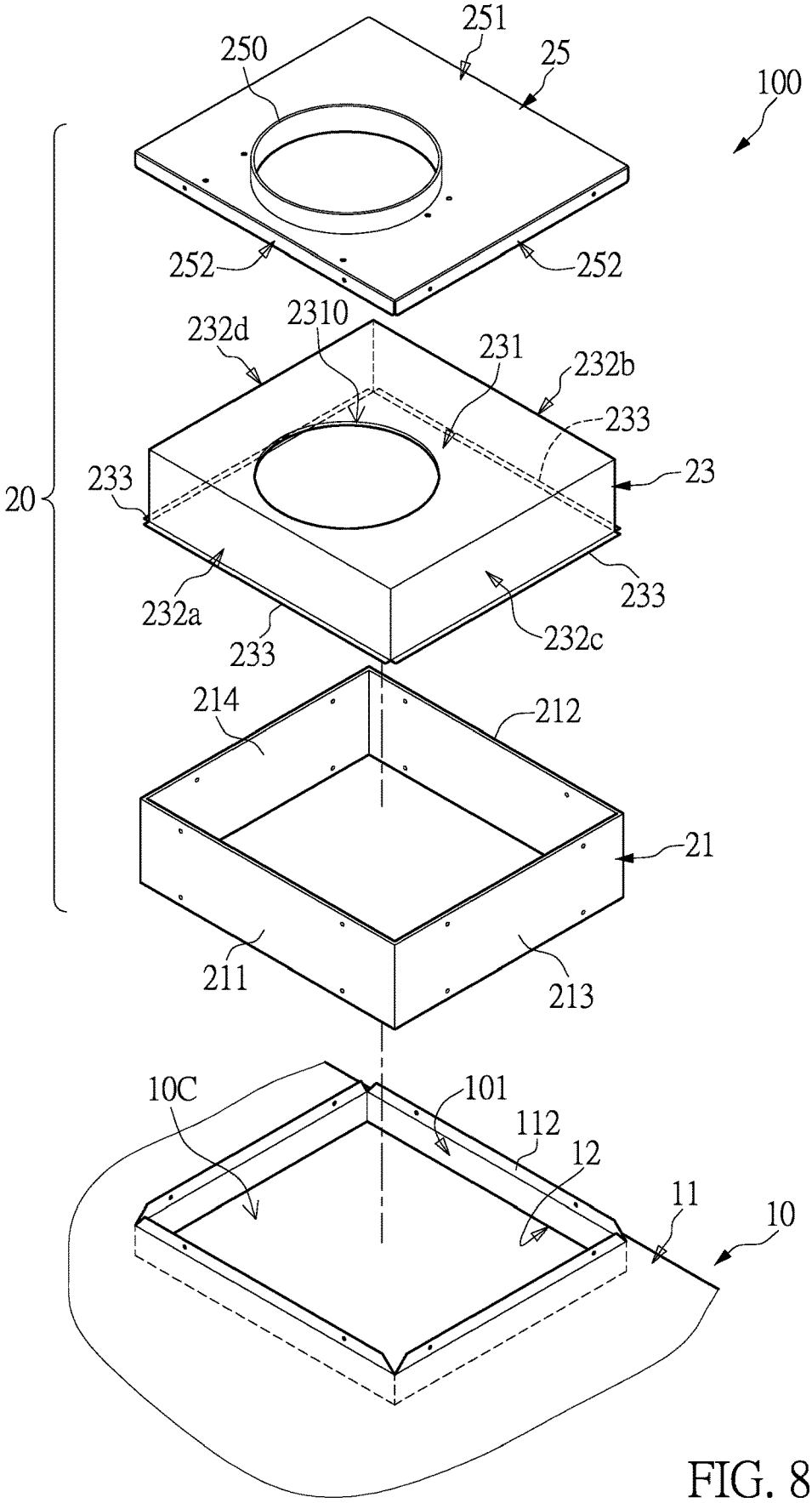
FIG. 8 is a perspective exploded view of the split-type range hood according to a second embodiment of the present disclosure.

Referring to FIG. 8, in this embodiment, the auxiliary-shielding member 14 is omitted. The guiding shell 23 has four shielding tabs 233 and four side guiding walls (232*a*, 232*b*, 232*c*, 232*d*). The four shielding tabs 233 are bent and extend outward from the four side guiding walls (232*a*, 232*b*, 232*c*, 232*d*), respectively. In this embodiment, the quantity of the shielding tabs 233, which is four, is equal to the quantity of the side guiding walls (232*a*, 232*b*, 232*c*, 232*d*) which is four. In other words, a lower edge of each side guiding wall (232*a*, 232*b*, 232*c*, 232*d*) is bent outward and extends to form one of the shielding tabs 233.

In this embodiment, controlling wires (not shown in the figures) can be arranged to pass through the space between the upper wall 11 and the lower wall 12 of the housing 10, the inner wall 101, the gap G, and the top covering wall 251 of the covering lid 25, and then connect to the control box 30. Therefore, the wires of this embodiment can still be completely hidden.

Third Embodiment

Figure 9:
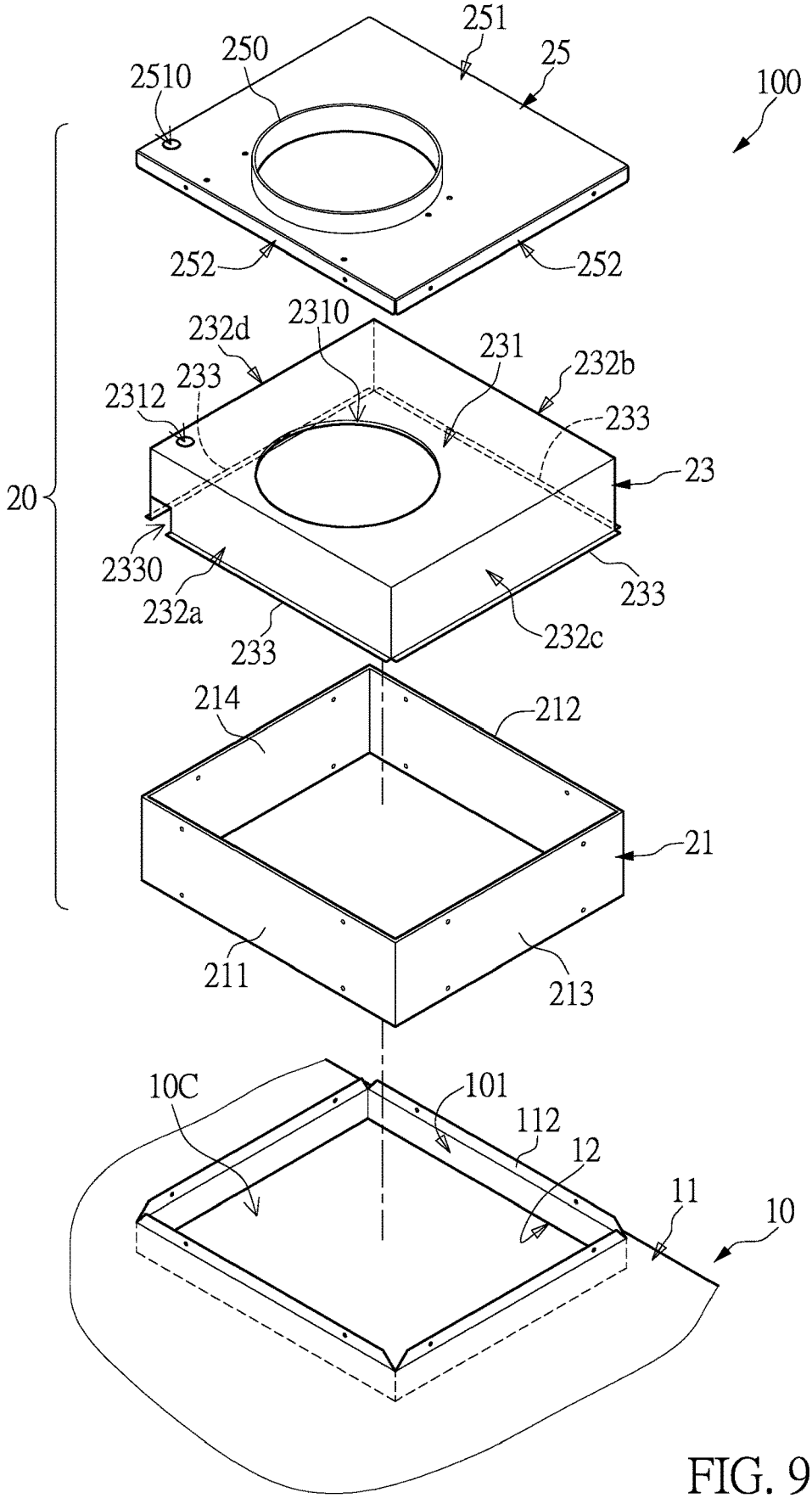
FIG. 9 is a perspective exploded view of the split-type range hood according to a third embodiment of the present disclosure.

Referring to FIG. 9, in this embodiment, the guiding shell 23 includes four shielding tabs 233 and four side guiding walls (232*a*, 232*b*, 232*c*, 232*d*). The four shielding tabs 233 are bent and extend outward from the four side guiding walls (232*a*, 232*b*, 232*c*, 232*d*), respectively. The front one of the side guiding wall 232*a* has a cutout 2330 formed thereon. A first wire hole 2312 is formed on the top guiding wall 231 of the guiding shell 23, and a second wire hole 2510 is formed on the top covering wall 251 of the covering lid 25.

In this embodiment, controlling wires (not shown in the figures) can be arranged to pass through the space between the upper wall 11 and the lower wall 12 of the housing 10, the cutout 2330, the first wire hole 2312 of the guiding shell 23, and the second wire hole 2510 of the covering lid 25, and then connect to the control box 30.

Beneficial Effects of the Embodiments

In conclusion, at least one beneficial effect of the present disclosure is that, after experiments, the split-type range hood 100 provides an optimal configuration of a smoke-collecting case having a height between 1 cm and 10 cm, so that the flow speed at the entrance of the outlet port can be increased and the noise can be reduced. Therefore, the fume can be more smoothly exhausted outside through the guiding shell of the smoke-collecting case.

In addition, the guiding shell 23 is arranged in the outer box 21 of the smoke-collecting case 20, and the covering lid 25 is fixedly connected to a top portion of the outer box 21, so that the fixing elements can be prevented from being exposed from an interior of the smoke-collecting case 20. Therefore, the turbulence of the fume can be reduced. The fume can pass through the guiding shell 23 and be more smoothly exhausted outward from the outlet port 250 of the covering lid 25. In addition, the fume is not attached by screws, so that cleanliness is easily maintained and the guiding shell 23 can be more smoothly wiped clean.

In addition, the gap G is formed between the side guiding wall of the guiding shell 23 and the outer box 21, and the gap G can be used as a wiring space for wires, so that the guiding shell 23 does not need a wire hole to be formed thereon. Therefore, the appearance of the range hood and the smoothness of a fume flow in the present disclosure can be improved.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A split-type range hood having an optimal configuration, comprising:

a housing including an upper wall, a lower wall, and an intake port, wherein the intake port is fluidly connected to the upper wall and the lower wall; and a smoke-collecting case covering on the intake port and protruding above the upper wall, wherein the smoke-collecting case includes an outer box and a covering lid, the outer box is fixed to a periphery of the intake port, and the covering lid is fixedly connected to a top portion of the outer box; wherein the covering lid has an outlet port, the outlet port fluidly connects the smoke-collecting case to the intake port of the housing, a height of the smoke-collecting case is between 1 cm and 10 cm, so that a fume can pass through the smoke-collecting case to be exhausted outside from the outlet port of the covering lid;

wherein the intake port is in a shape of a rectangle, the outer box has four box plates each in a shape of a rectangular tube, and the outlet port is in a shape of a round hole, wherein a ratio of an area of the outlet port to an area of the intake port is 0.24:1, and a height of the outer box is 7 cm.

2. The split-type range hood according to claim 1, wherein the upper wall of the housing has a plurality of connection walls, the plurality of connection walls extend upward and are bent from the upper wall along the periphery of the intake port, and a bottom portion of the outer box is fixedly connected to the plurality of connection walls.

3. The split-type range hood according to claim 1, wherein the covering lid includes a top covering wall and a plurality of assembling flaps, the plurality of assembling flaps are bent downward from a periphery of the top covering wall, the outlet port protrudes upward from the top covering wall, and the plurality of assembling flaps are fixedly connected to the outer box.

4. The split-type range hood according to claim 1, wherein the smoke-collecting case further includes a guiding shell, and the guiding shell is disposed in the outer box; wherein a top end of the guiding shell is fixedly connected to the covering lid, a bottom edge of the guiding shell has a plurality of shielding tabs that extend outwardly, the plurality of shielding tabs are adjacent to an inner wall of the intake port, and the guiding shell has four sides that are arranged to have a shape of a rectangular tube.

5. The split-type range hood according to claim 4, wherein the guiding shell includes a top guiding wall and a plurality of side guiding walls, and the plurality of side guiding walls are connected to a periphery of the top guiding wall; wherein the plurality of shielding tabs are connected to the plurality of side guiding walls, and a quantity of the plurality of shielding tabs is less than a quantity of the plurality of side guiding walls.

6. The split-type range hood according to claim 5, wherein a vent is formed in the top guiding wall, the vent corresponds in position to the outlet port, and the top guiding wall is fixedly connected to the covering lid.

7. The split-type range hood according to claim 5, further comprising an auxiliary-shielding member, the guiding shell has three of the shielding tabs and four of the side guiding walls, and a height of one of the four side guiding walls without the shielding tab is lower than a height of another three of the four side guiding walls, so as to form a gap between the one of the four side guiding walls without the shielding tab and the outer box and a concave portion; wherein the auxiliary-shielding member is fixed to one side of the inner wall of the intake port and shields the concave portion, and the auxiliary-shielding member is L-shaped.

8. The split-type range hood according to claim 7, further comprising a control box and a hood filter, wherein the control box is disposed on the covering lid of the smoke-collecting case, a controlling wire is arranged from the housing through the gap and passes through the covering lid to be connected to the control box, and the hood filter is disposed at the intake port and abuts against the auxiliary-shielding member.

9. The split-type range hood according to claim 4, wherein the guiding shell includes a top guiding wall and a plurality of side guiding walls, and the plurality of side guiding walls are connected to a periphery of the top guiding wall; wherein the plurality of shielding tabs are connected to the plurality of side guiding walls, and a quantity of the plurality of shielding tabs is equal to a quantity of the plurality of side guiding walls.

* * * * *